United States Patent [19]

Timmins et al.

[11] 4,182,239

[45] Jan. 8, 1980

[54] CABLE AND HOSE MARKING MACHINE

[76] Inventors: Michael D. Timmins, 7712 Parma La., San Diego, Calif. 92126; Larry L. Trepanier, 10225-166 Caminito Cyervo, San Diego, Calif. 92108

[21] Appl. No.: 887,673

[22] Filed: Mar. 17, 1978

[51] Int. Cl.[2] ..... B41F 17/10

[52] U.S. Cl. ..... 101/11; 101/29; 101/43; 101/292

[58] Field of Search ..... 101/36, 37, 35, 41–44, 101/3 R, 4, 9–11, 29, 292, 288

[56] References Cited

U.S. PATENT DOCUMENTS

| | | | |
|---|---|---|---|
| 2,081,523 | 5/1937 | Baker | 101/288 |
| 2,186,788 | 1/1940 | Olson | 101/37 X |
| 2,517,493 | 8/1950 | Kingsley | 101/4 UX |
| 2,925,773 | 2/1960 | Kingsley | 101/11 |

*Primary Examiner*—Clifford D. Crowder
*Attorney, Agent, or Firm*—Brown & Martin

[57] ABSTRACT

A cable and hose marking machine for imprinting identifying markings on plastic covered cable or hose, which is fed through the machine by a continuously rotating pulley. At timed intervals a cam mechanism disengages the drive and actuates a printing head carrying heated dies, which are pressed against the momentarily stationary cable or hose supported in a rigid guide. The machine is readily adjustable for various sizes of cable and hose.

4 Claims, 4 Drawing Figures

CABLE AND HOSE MARKING MACHINE

BACKGROUND OF THE INVENTION

Many types of cables and hoses are required to carry identification markings at spaced intervals along their lengths. To print such identification it is necessary to feed the cable or hose past a printing station where the markings are applied. The motion of the cable or hose must be stopped as the imprint is made, or the printing head must be moved cyclically to match the speed of the cable or hose. The latter arrangement would require a complex mechanism to advance and return a printing head. Intermittent motion of the cable or hose requires a stop and start drive mechanism synchronized with the action of the printing head, which can also become complex.

SUMMARY OF THE INVENTION

The machine described herein advances a cable or hose by means of a continuously running friction drive around a pulley, on which the cable or hose is held by a pressure roller carried on one end of a pivotal arm. A cam on the pulley drive shaft moves the arm and releases the pressure roller at each revolution, allowing the pulley to slip. On the other end of the pivoted arm is a printing head with heated dies of the required markings, the head being pressed against the cable or hose by the cam action while the drive is slipping. The cable or hose is supported at the printing station by a rigid back-up guide extending along the path of the cable or hose. An adjustment on the pivoted arm allows the head to be positioned for various sizes of cable or hose. The machine is thus very simple in structure and is capable of operating automatically for long periods.

The primary object of this invention, therefore, is to provide a new and improved cable and hose marking machine.

A further object of the invention is to provide an improved cable and hose marking machine that is light in weight and portable.

Another object of this invention is to provide a cable and hose marking machine having a continuous friction drive for advancing a cable or hose, with timed means for releasing the drive and simultaneously imprinting the momentarily stationary cable or hose.

A further object of this invention is to provide a cable and hose marking machine which is readily adjustable for various sizes of cable or hose.

Other objects and advantages will be apparent in the following detailed description, taken in conjunction with the accompanying drawing, in which.

DESCRIPTION OF THE PREFERRED EMBODIMENT

Figure 1:
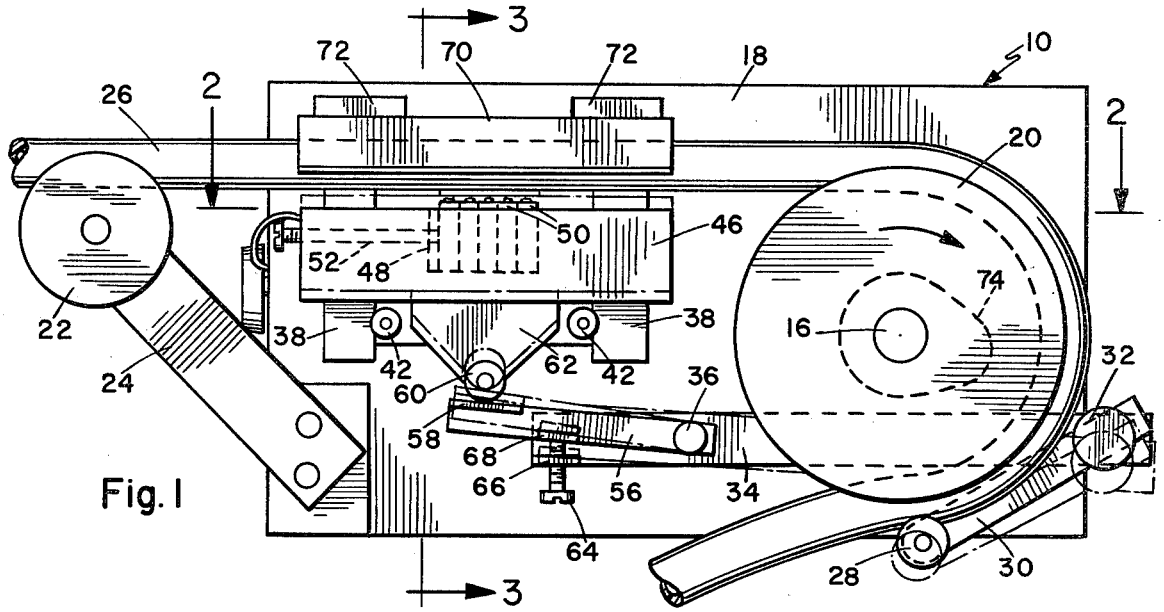
FIG. 1 is a front elevation view of the machine.
Figure 2:
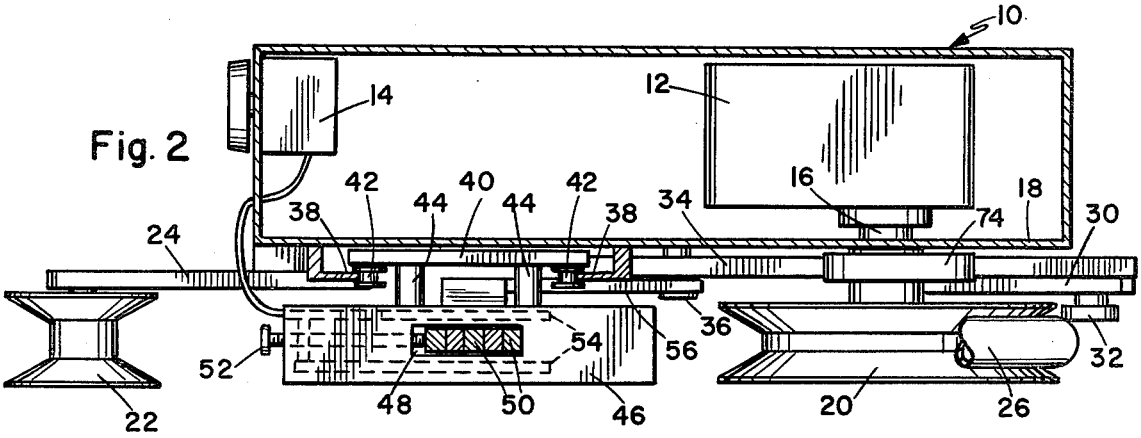
FIG. 2 is a sectional view taken on line 2—2 of FIG. 1.
Figure 3:
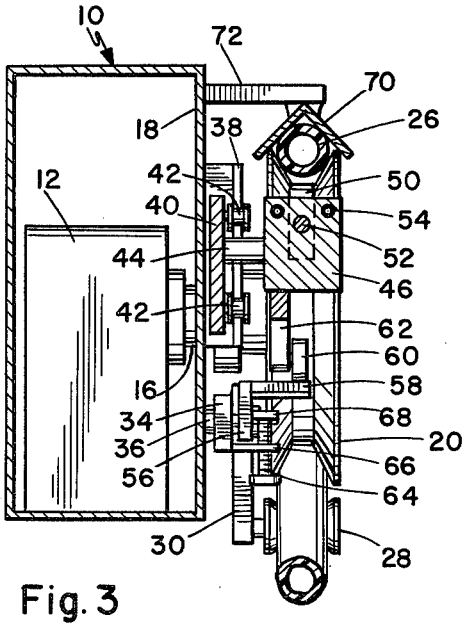
FIG. 3 is a sectional view taken on line 3—3 of FIG. 1.
Figure 4:
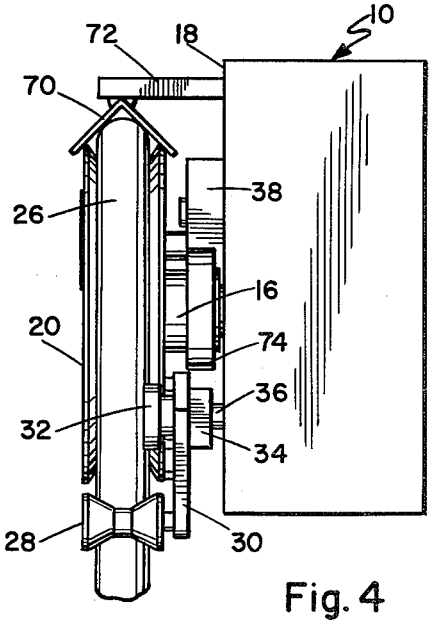
FIG. 4 is an end elevation view as taken from the right hand end of FIG. 1.

As illustrated the machine is mounted on a box or housing 10, but could be on any suitable supporting surface. Housing 10 conveniently contains the drive motor 12, heat control 14 and any other associated apparatus.

Drive motor 12 has a shaft 16 projecting through the front wall 18 adjacent one end of housing 10, and fixed on the shaft is a large V-grooved drive pulley 20. At the other end of the housing is a small V-grooved guide pulley 22, freely rotatably mounted on a support arm 24. The member to be marked, shown as a hose 26, passes over guide pulley 22 and is wrapped around drive pulley 20 for approximately half its circumference, so that the drive pulley can have a frictional driving grip on the hose. The hose is held against the drive pulley by a pressure roller 28 freely rotatably mounted on an adjustment arm 30, which is adjustably secured by a clamp screw 32 to one end of an actuating lever 34. The actuating lever is pivotally mounted on a pivot pin 36 projecting from front wall 18.

Fixed to front wall 18 are spaced vertical tracks 38 which support a carriage 40 having rollers 42 riding on the tracks. Extending from the carriage 40 are posts 44 which support a printing head 46. The printing head has a cavity 48 to hold a plurality of dies 50 carrying the required indicia to be imprinted on the hose 26. The dies are locked in place by a lock screw 52 in one end of the head 46, and are heated by heating elements 54 embedded in the head. The heating elements 54 are connected through heat control 14 to a suitable power supply, now shown, the arrangement being well known.

Vertical movement of the printing head 46 is controlled by the actuating lever 34 to move the printing head between a retracted position and a printing position. Extending from the actuating lever is an adjustment lever 56, which is also pivotal on pivot pin 36. The extended end of adjustment lever 56 has a pressure plate 58, which bears against a roller 60 on a bracket 62 extending downwardly from printing head 46. Adjustment lever 56 is adjusted by means of a setting screw 64 threaded upwardly through a lug 66 on actuating lever 34 and engaging a tab 68 on the underside of the adjustment lever.

Above and parallel to the printing head 46 is an inverted V-shaped back-up guide 70, under which the hose 26 passes. Back-up guide 70 is supported by brackets 72 on front wall 18, and provides a support channel for the hose when the printing head is actuated.

The mechanism is operated by a cam 74 fixed to shaft 16 to engage the upper face of actuating lever 34. At each revolution of drive pulley 20, cam 74 forces down the end of actuating lever 34 which carries the pressure roller 28. This releases pressure on hose 26 and allows the drive pulley 20 to slip, so that the hose stops moving. At the same time the other end of actuating lever 34 is forced up, causing adjustment lever 56 to lift the printing head 46, as indicated in the broken line position in FIG. 1. The heated dies 50 are thus pressed into the momentarily stationary hose, which is held against back-up guide 70.

As cam 74 continues to rotate, the actuating lever 34 is released and the weight of the printing head 46 forces that end of the lever down. This brings pressure roller 28 back up into contact with the hose 26, restoring the frictional grip of the drive pulley 20 on the hose. The weight of the printing head is normally sufficient to apply the necessary force to pressure roller 28, but a spring could be installed if desired to assist the action.

Since the printing action occurs at each revolution, the circumference of the drive pulley 20 determines the spacing between markings on the hose. To accommodate different sizes of hose, or cable, the clearance of the printing head below the back-up guide can be adjusted by means of setting screw 64, to change the angular relationship of the adjustment lever to the actuating lever. This raises or lowers the adjustment lever 56 and sets the low or retracted position of the printing head. The proper stroke and imprint pressure can thus be maintained for different sizes of hose. Drive pressure on the hose is adjusted for different hose sizes by moving adjustment arm 30 and securing it with clamp screw 32.

Dies 50 are easily changed by releasing lock screw 52, and can be set up in any required arrangement. Cavity 48 can be of any suitable size to hold as many dies as necessary.

The simple cam mechanism operating a single lever to stop the drive action and perform the printing, allows the use of a single continuously running drive motor. This eliminates the need for complex timing and switching mechanisms and minimizes wear on the motor.

Having described our invention, we claim:

1. A cable and hose marking machine, comprising:

a support member;

a motor mounted on said support member adjacent one end, said motor having a drive shaft with a grooved drive pulley thereon for continuous rotation;

a support pulley mounted adjacent the other end of said support member for supporting a cable or hose extending between the pulleys;

a channelled back-up guide fixed to said support member to support a portion of a cable or hose between the pulleys;

a printing head movably mounted on said support member opposed to said back-up guide, and being movable between a retracted position clear of the back-up guide and a printing position in contact with a cable or hose supported in the back-up guide;

an actuating lever pivotally mounted on said support member;

a pressure roller mounted on one end of said actuating lever for holding a cable or hose wrapped around substantially half the circumference of said drive pulley and in frictional contact therewith;

the other end of said actuating lever being coupled to said printing head; and a cam on said drive shaft for engaging said actuating lever as the drive shaft rotates and simultaneously releasing the pressure of said pressure roller and moving said printing head into the printing position.

2. A cable and hose marking machine according to claim 1, and including an adjustment arm adjustably secured to said one end of the actuating lever, said pressure roller being freely rotatably mounted on said adjustment arm for adjusting the spacing of the pressure roller from the drive pulley to accommodate various sizes of cable or hose.

3. A cable and hose marking machine according to claim 1, and including an adjustment lever pivotally mounted adjacent said other end of the actuating lever, said adjustment lever having an extended end engaging said printing head, and adjustment means on said actuating lever for varying the angular relationship of the adjustment lever to the actuating lever.

4. A cable and hose marking machine according to claim 3, and including tracks on said support member, a roller supported carriage movably mounted on said tracks, said printing head being secured to said carriage, said printing head having a roller thereon, and said extended end of the adjustment lever having a pressure plate engaging said roller to move the printing head.

* * * * *